United States Patent [19]

Monteyne

[11] 4,374,645

[45] Feb. 22, 1983

[54] PROCESS FOR GRANULATION OF SLAG

[75] Inventor: Guido Monteyne, Lembeke, Belgium

[73] Assignee: Paul Wurth S.A., Luxembourg

[21] Appl. No.: 267,880

[22] Filed: May 28, 1981

[30] Foreign Application Priority Data

Jul. 4, 1980 [LU] Luxembourg ..... 82585

[51] Int. Cl.[3] ..... B01J 2/02

[52] U.S. Cl. ..... 23/293 A; 264/11; 266/202; 422/278

[58] Field of Search ..... 23/293 A; 422/253, 261, 422/278; 264/11; 425/7; 65/141; 266/202

[56] References Cited

U.S. PATENT DOCUMENTS

| | | | |
|---|---|---|---|
| 2,330,038 | 9/1943 | Ervin | 264/11 |
| 3,023,454 | 3/1962 | Kuzell et al. | 264/11 |
| 3,201,105 | 8/1965 | Miller | 266/202 X |
| 3,374,999 | 3/1968 | Burch | 266/202 X |
| 3,428,718 | 2/1969 | Helin et al. | 264/11 |
| 3,833,354 | 9/1974 | Thummler et al. | 264/11 X |
| 3,891,730 | 6/1975 | Wessel et al. | 264/11 |
| 4,233,007 | 11/1980 | Karlsson | 425/7 |

FOREIGN PATENT DOCUMENTS

| | | |
|---|---|---|
| 359405 | 10/1931 | United Kingdom . |
| 359406 | 10/1931 | United Kingdom . |
| 464917 | 4/1937 | United Kingdom . |

*Primary Examiner*—Richard L. Chiesa
*Attorney, Agent, or Firm*—David S. Fishman

[57] ABSTRACT

The granulation of molten material, blast furnace slag for example, is accomplished by wetting the slag with a stream of water and thereafter transporting the thus formed granules away from the point of granulation with the water stream. Water consumption is minimized and average grain size increased by employing a multi-layer water stream defined by currents having different temperatures and pressures.

11 Claims, 5 Drawing Figures

PROCESS FOR GRANULATION OF SLAG

BACKGROUND OF THE INVENTION (1) Field of the Invention

The present invention relates to the treatment of molten slag, slag being withdrawn from a blast furnace for example, and particularly to the granulation of such molten slag. More specifically, this invention is directed to apparatus for treating molten slag with water to form a granulated product. Accordingly, the general objects of the present invention are to provide novel and improved methods and apparatus of such character.

(2) Description of the Prior Art

It is known to mix the molten slag withdrawn from a furnace with water to form a solid product. Specifically, it is known to convey molten slag into a water stream to thereby produce a granulated product which, after drying, may be handled with relative ease. The foregoing has been accomplished by directing the molten slag into a trough through which a stream of water flows. The pressure and the rate of flow of the water must be sufficiently high to insure that the slag will be entrained therein and thus will flow along with the water to a filtration pit. Also, the quantity and temperature of the water must be selected so as to insure complete granulation.

To briefly elaborate on the foregoing, in order to insure complete granulation and to prevent the formation of deposits of granulated slag in the trough, a stream of pressurized water must be employed. In actual practice, in the treatment of four to seven tons of slag per minute, it was not uncommon in the prior art for 2000 $m^3$ of water per hour to be required. The use of this much water, and the power requirements incident to the pumping thereof, constitute obvious disadvantages from both economic and environmental viewpoints. It is also to be observed that, since the water employed for granulation must be re-separated from the mixture in order to obtain a filtered granulated slag with a low moisture content, a reduction in the quantity of granulation water would enable the employment of filtration installations of a more modest size than presently required.

The average size of granules of slag produced in the above-described method is known to be partly a direct function of the temperature of the water with which the molten slag is mixed. Thus, the average size of the slag particles formed during the granulation process will increase with an increase in the temperature of the granulation water. In order to produce a granulated product having a relatively large average grain size with a comparatively low proportion of fines, which is more readily marketable and from which water may be more easily separated, relatively high temperature granulation water should be employed. However, if the granulation water is too hot the final temperature of the granulated slag-water mixture, hereinafter referred to as the "pulp", will be higher than can be safely handled by apparatus downstream of the mixing station. Accordingly, in the prior art granulation water at reduced temperature has been employed and the industry has been reconciled to the achievement of a smaller average grain size than desired for the slag and a comparatively high proportion of fines.

SUMMARY OF THE INVENTION

The present invention overcomes the above briefly described and other deficiencies and disadvantages of the prior art by providing a novel and improved process for the granulation of molten slag wherein the consumption of water is considerably reduced when compared to the prior art and a larger average grain size than previously achieved is obtained. The present invention also encompasses apparatus for use in the practice of the aforesaid improved granulation process.

In accordance with the present invention a stream of molten slag is caused to fall into a stream of pressurized water and the resulting mixture of water and granulated slag is conveyed along a trough to a filtration stage. The present invention resides in the production of a granulation water stream comprising plural currents or layers. A first of these currents is initially contacted by the molten slag and primarily produces the granulation of the slag. A second of these currents serves primarily to insure the complete evacuation of the granulated slag from the trough. The temperature and pressure of the first current are higher than the temperature and pressure of the second current.

In the practice of the present invention the second current or layer of the granulation water stream will be coaxial with the first current and will be disposed at least partly below the first current. This lower current may consist of industrial water at ambient or reduced temperature. The first or upper current of the granulation stream may consist of recycled water which emanates, for example, from a filter bed of the filtration stage to which the granulated slag is conveyed by the granulation water stream, the temperature of this recycled water thus typically being in the range of 50°–70° C.

The present invention, accordingly, resides in the separation of the two principal functions of the water used in the granulation process, i.e., the granulation of the molten slag and the movement of the pulp. This separation of functions permits a reduction in the consumption of granulation water and also allows the temperature of the water which impinges upon the molten slag to be increased above ambient if deemed necessary or desirable. The reduction in the rate of flow of the granulation water may be attributed to the fact that a high pressure stream is required only in the upper layer or current for the purpose of wetting and simultaneously deflecting the molten slag which falls from a feed channel, the slag thus passing through the upper layer of the granulation water stream and falling to the bottom of the trough as a granulated material. The pressure, and thus the consumption of the lower layer or current of the stram may be reduced to the level required to insure continuous evacuation of the granulated material from the trough and to prevent deposits from forming in the trough.

Since, in accordance with the present invention, the granulation process principally occurs through the reaction of molten slag with the upper layer or current of the granulation water stream, the temperature of this upper layer may be raised in order to increase the granulometry of the slag. However, this increase in temperature of a portion of the stream does not significantly increase the final temperature of the pulp since the mixture of the upper current with the ambient temperature water of the lower current results in the final temperature of the pulp remaining within acceptable limits.

Apparatus in accordance with the present invention includes means for producing a stream of pressurized water and for directing this stream against the stream of molten slag which is falling in a substantially vertical direction toward the first end of a delivery trough which conveys the resulting pulp to a filtration stage. The apparatus for producing the granulation water stream consists of a pair of separated compartments, formed in a single chamber, with each compartment being connected to a separate source of pressurized water. The chamber will have a shape which generally corresponds to that of the trough into which the molten slag falls and the two compartments will be coaxially arranged within the chamber. The water will be delivered into the trough from the two compartments in the form of jets.

In accordance with a preferred embodiment of the invention, the front wall of the chamber, and thus the front walls of the respective compartments, will be defined by perforated plates. The perforations in these plates will be arranged to define parallel, preferably arcuate, streams which define two layers or currents directed along the trough. Additionally, the plates are formed so as to define a pair of generally arcuate exit ports from each of the compartments with the flow exiting one of these ports being directed generally along the wall of the trough and the flow exiting the other port being disposed inwardly toward the trough axis with respect to the flow established by the port and perforations in the other plate. The arcuate discharge ports from the two compartments result in the generation of films of water of preferably concave cross-section which sweep the bottoms of the two compartments and thus prevent formation of deposits of particulate matter therein. Additionally, the film of water discharged from the lower or outwardly disposed compartment also sweeps the bottom of the trough immediately downstream of the front wall of the chamber and thus prevents the formation of deposits in this region of the trough. The perforated plates which form the compartment front walls, and thus define the two layers of the granulation stream, are detachably affixed to the stream production means and may be easily moved for repair or replacement.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 1:
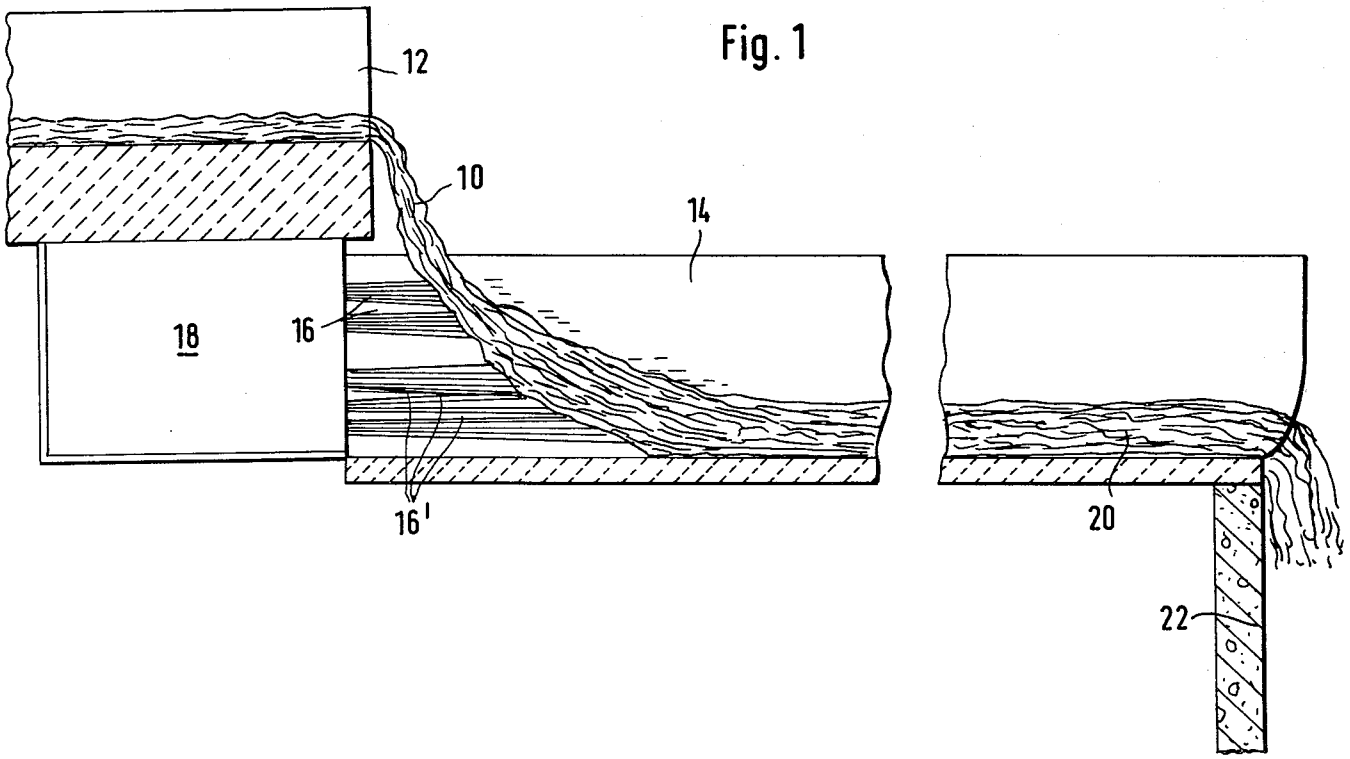
FIG. 1 is a cross-sectional, side-elevation schematic view of apparatus in accordance with the present invention.

With reference to FIG. 1, a stream of molten slag 10 emanating from a metallurgical furnace, a blast furnace for example, flows through a channel 12 of refractory material. The slag 10, when it reaches the end of channel 12, falls under the influence of gravity into a trough or spout 14. In its fall, the molten slag 10 is intercepted by a powerful stream of water, indicated at 16 and 16', which is defined by a multiplicity of separate jets discharged from a chamber 18. In accordance with the present invention, the stream of water which intercepts molten slag 10 comprises an upper portion or layer 16, which serves essentially to wet the molten slag thus causing the granulation thereof, and a lower portion or layer 16', which insures that the granulated slag will be moved along trough 14. The pulp 20, i.e., the mixture of water and granulated slag, is delivered by trough 14 into a pit 22 for further treatment.

Figure 2:
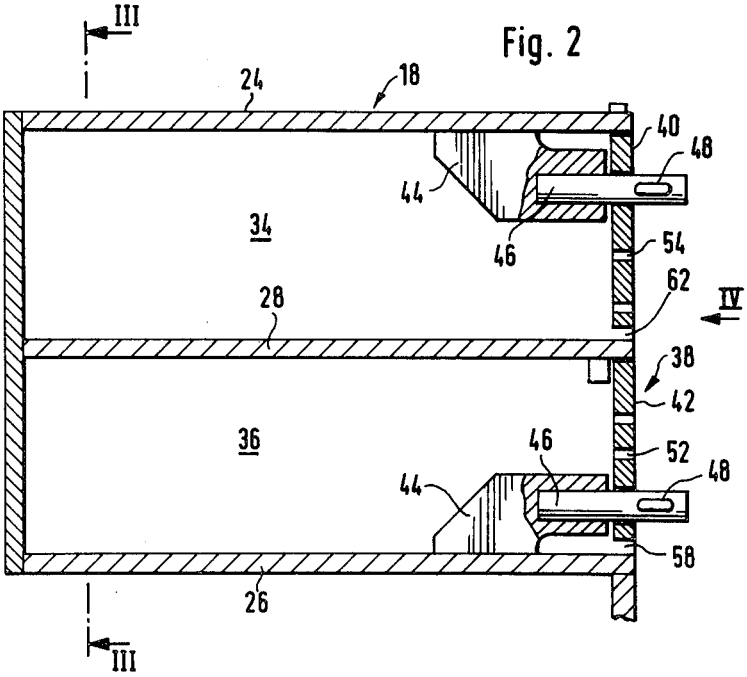
FIG. 2 is a schematic, cross-sectional, side-elevation view of the device for generating the granulation water stream of the FIG. 1 apparatus.
Figure 3:
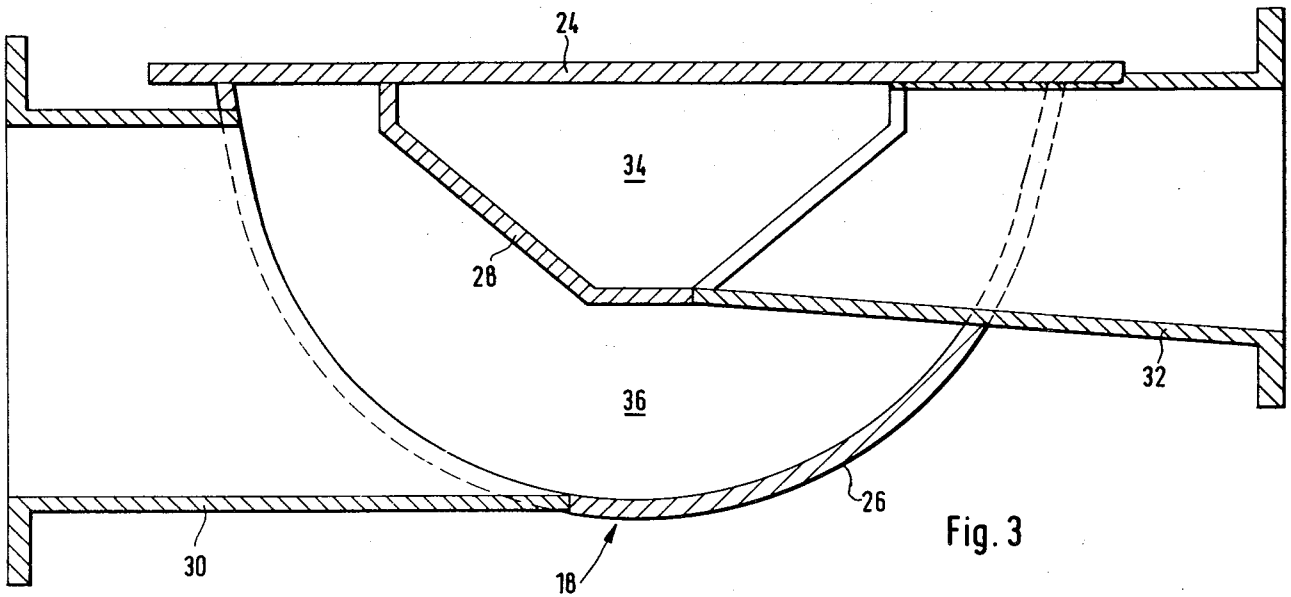
FIG. 3 is a view, taken along line III—III, of the device of FIG. 2.
Figure 4:
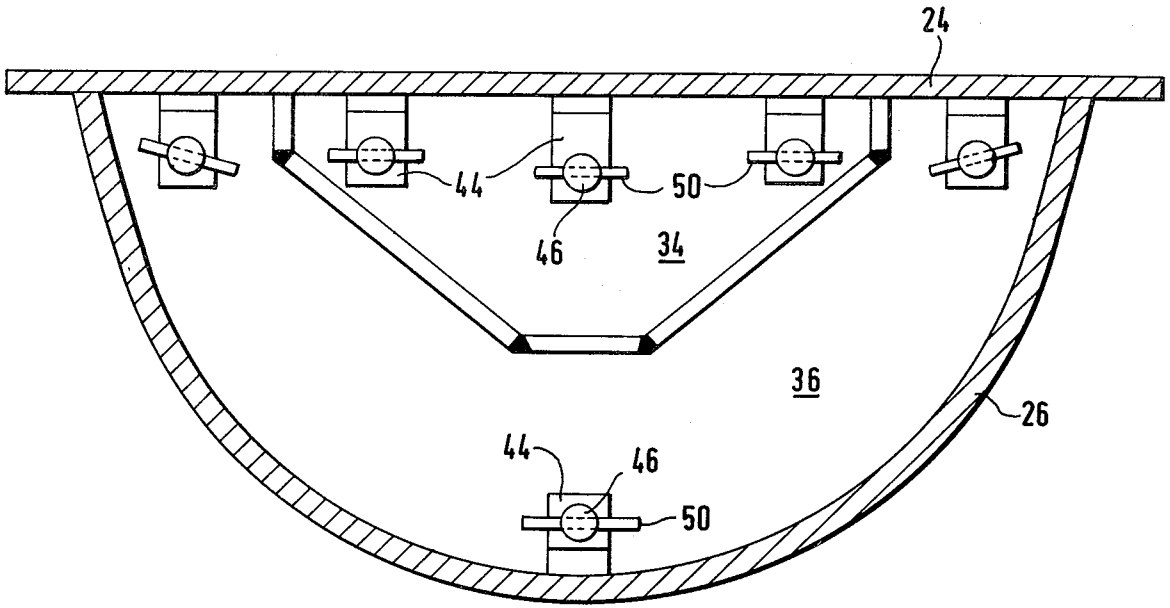
FIG. 4 is a front view, taken in the direction of arrow IV, of the device of FIG. 2 with the front wall of the device removed.

Referring simultaneously to FIGS. 2, 3 and 4, the chamber 18, which comprises the means for generating the granulation stream 16, 16', will now be described.

Chamber 18 includes a base 26 which, in the disclosed embodiment, is of a substantially semi-cylindrical shape. Base 26 will correspond to the shape of the trough 14 and thus may be considered a prolongation thereof. Chamber 18 is further defined by an upper wall 24 which may consist merely of a flat plate welded or otherwise secured to base 26. Chamber 18 additionally includes an internal partition 28 which subdivides the interior of the chamber into coaxial compartments 34 and 36. Partition 28 will, as was base member 26, be welded or otherwise secured to upper wall 24. The partition 28 may have a semi-cylindrical shape or, as shown, a polygonal shape. The compartments 34 and 36 defined by partition 28 are fluidically isolated from one another and are connected to respective feed conduits 32 and 30 whereby water at different temperature and pressure may be delivered to the two separate compartments.

The front wall 38 of chamber 18, which faces into the trough 14, is defined by a pair of plates 40 and 42 in the disclosed embodiment. These two plates, which will be described in greater detail below, are best seen from FIG. 5. The plates 40 and 42 are detachably affixed to chamber 18 so that they may be easily and rapidly removed and replaced. Thus, referring to FIGS. 2 and 4, base 26 and upper wall 24 are provided with a series of blocks 44 which have, projecting forwardly therefrom, rods 46. The rods 46 cooperate with mounting holes 56 provided in plates 40 and 42. Each of the rods 46 is provided with an elongated slot or aperture 48 designed to receive a pin or key 50 (FIG. 4). Thus, to remove the plates 40 and 42, it is necessary only to drive the pins 50 from the slots 48 in rods 46 and subsequently slide the plates 40 and 42 forwardly off the rods. The reassembly operation is, of course, carried out in the reverse order.

Figure 5:
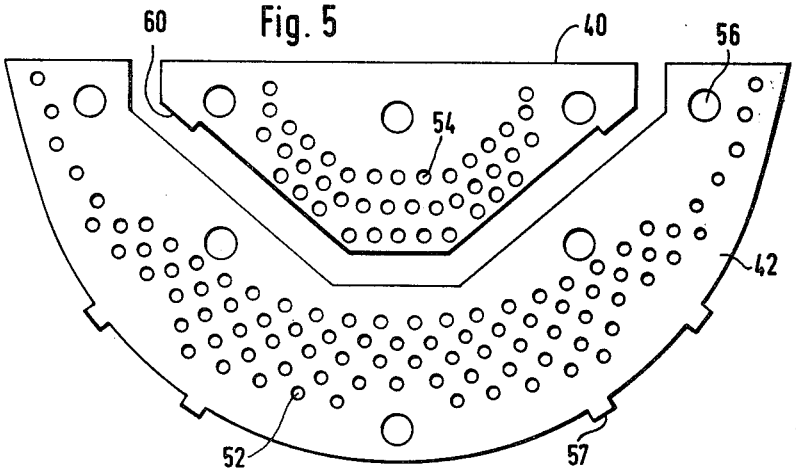
FIG. 5 is a plan view of the plates which define the front wall of the device of FIGS. 2–4 in accordance with a preferred embodiment.

Referring now to FIG. 5, the configuration of plates 40 and 42 is clearly shown. The plates 40 and 42 have respective arrays of perforations 54 and 52 which, when the compartments 34 and 36 are charged with pressurized water, define jets of water which are directed into trough 14. The general configuration of each of the arrays of perforations 54 and 52 is that of a crescent having its concave side facing upwardly. The pattern of perforations 52 in plate 42 is chosen to insure that the base of trough 14 will be completely covered with a flowing stream of water during the granulation process. The shape of the pattern of perforations 54 in plate 40 is chosen so as to insure that the sheet or stream of molten slag falling from channel 12 will be satisfactorily intercepted and deflected.

Continuing to refer to FIG. 5, the lower edge of plate 42 is provided with a number of protuberances 57 which, with the plate installed as shown in FIG. 2, will bear on the base 26 of chamber 18. The protuberances 57 result in a gap 58 being present between plate 42 and base 26 and this gap forms an arcuate discharge port for compartment 36. Similarly, the upper plate 40 is provided with at least two protuberances 60 which form a gap between plate 40 and partition 28. The gap between plate 40 and partition 28 defines an arcuate discharge port for compartment 34. It is to be noted that it is not necessary that the arcuate gaps or discharge ports 58 and 62 extend all the way to the upper wall 24 of chamber 18. It is also to be noted that the front wall 38 of chamber 18 could, if deemed desirable, be formed from a single plate rather than employing the dual plate construction described above.

In operation, "hot" water at a comparatively high pressure is supplied to compartment 34 via conduit 32 and is discharged into trough 14, so as to wet and deflect the falling molten slag, as a crescent shaped pattern of high pressure jets and an arcuate film or sheet. The high pressure jets are defined by the perforations 54 while the arcuate film or sheet is defined by the gap 62. Simultaneously, water at ambient temperature and at a lower pressure than with the water delivered to compartment 34 is supplied to compartment 36 via conduit 30. The water delivered to compartment 36 is also discharged into trough 14 in the form of a crescent shaped pattern of jets and an arcuate film or sheet. The pattern of jets emanating from compartment 36 is defined by the perforations 52 in plate 42 and is generally coaxial with and outwardly disposed from the stream defined by the perforations 54 in plate 40. The arcuate film or sheet discharged from compartment 36 is defined by gap 58 and washes that portion of trough 44 immediately downstream of plate 42 free of particulate matter. The compartments 34 and 36 are both washed free of particulate matter by the streams exiting from the discharge ports defined by the gaps between the plates and the members which define the bottoms of the compartments.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a process for the granulation of molten slag, the molten slag being wet by a stream of liquid to cause solidification of the molten slag in the form of granules which are transported by the stream, the improvement comprising:

establishing a stream of liquid having at least first and second liquid current components of different pressures and temperatures commensurate with different functions to be performed, the pressure and temperature of said first current component being higher than the pressure and temperature of said second current component;

causing a flow of molten slag to be intercepted and wet by said first liquid current component at the higher temperature and higher pressure of said first liquid current component, said first liquid current component primarily serving to effect the granulation of said molten slag; and entraining the granulated slag in said second liquid current component, said second liquid current component being at the lower temperature and pressure of said second liquid current component, to transport the slag to a desired destination;

the temperature and pressure of said first liquid current component being commensurate with requirements for granulation of the slag and the temperature and pressure of said second liquid current component being commensurate with requirements for transporting the slag.

2. The process of claim 1 wherein:

said first and second liquid current components are generally parallel contoured streams of liquid, with the first stream being at least partly contained within the contour of the second stream.

3. The method of claim 1 wherein the step of causing a first current to intercept the molten slag comprises:

forming a first pattern of liquid jets, said first pattern generally defining a crescent shape; and directing the first pattern of jets against a freely falling flow of the molten slag.

4. The method of claim 3 wherein the second liquid current component comprises water at ambient temperature and wherein the first liquid current component comprises water at a temperature in the range of 50°-60° C.

5. The method of claim 3 wherein the step of causing the granulated slag to be entrained comprises:

forming a second pattern of liquid jets, said second pattern of jets generally defining a crescent shape and being at least partly coaxial with the first pattern, the molten material falling through the first current into the second current.

6. The method of claim 5 wherein the liquid defining the first and second patterns of jets is water.

7. The method of claim 6 further comprising:

delivering part of said first liquid current component as an arcuately shaped layer of water at the first temperature and pressure into the region between said first and second patterns of jets.

8. The method of claim 6 wherein the entrained granular material flows along a trough and wherein said method further comprises:

delivering part of said second liquid current component as an arcuately shaped layer of water at the second temperature and pressure toward the region between the wall of the trough and the second pattern of jets.

9. The method of claim 8 further comprising:

delivering part of said first liquid current component as an arcuately shaped layer of water at the first temperature and pressure into the region between said first and second patterns of jets.

10. The method of claim 9 wherein the temperature of the water of said second liquid current component is ambient and the temperature of the water of said first liquid current component is in the range of 50°-60° C.

11. The method of claim 1 wherein the second liquid current component comprises water at ambient temperature and wherein the first liquid current component comprises water at a temperature in the range of 50°-60° C.

* * * * *